US006981588B2

(12) United States Patent
Kimura

(10) Patent No.: US 6,981,588 B2
(45) Date of Patent: Jan. 3, 2006

(54) PACKAGING MATERIAL FOR COMMODITY

(75) Inventor: Keiji Kimura, Suita (JP)

(73) Assignee: Yugen Kaisha Toho Label, Osaka (JP)

( * ) Notice: Subject to any disclaimer, the term of this patent is extended or adjusted under 35 U.S.C. 154(b) by 33 days.

(21) Appl. No.: 10/473,870

(22) PCT Filed: Feb. 6, 2002

(86) PCT No.: PCT/JP02/00999

§ 371 (c)(1),
(2), (4) Date: Sep. 29, 2003

(87) PCT Pub. No.: WO02/081334

PCT Pub. Date: Oct. 17, 2002

(65) Prior Publication Data

US 2004/0112772 A1 Jun. 17, 2004

(30) Foreign Application Priority Data

Mar. 30, 2001 (JP) ..... 2001-099818

(51) Int. Cl.
*B65D 85/18* (2006.01)

(52) U.S. Cl. ..... 206/297; 206/278; 206/292

(58) Field of Classification Search ..... 206/278, 206/292, 297, 299, 284, 476, 495, 525.1, 206/806; 223/87; 229/87.15; 40/124.09
See application file for complete search history.

(56) References Cited

U.S. PATENT DOCUMENTS 1,720,679 A * 7/1929 Karn ..... 206/295
1,883,852 A * 10/1932 Medoff ..... 206/449
2,320,018 A * 5/1943 Ullman ..... 229/120.18
3,329,386 A * 7/1967 Rosen ..... 248/340
4,190,151 A * 2/1980 Russell ..... 206/281
4,258,842 A * 3/1981 Falkstein ..... 206/8
6,032,793 A * 3/2000 Oakley ..... 206/296
6,237,762 B1 * 5/2001 Faircloth ..... 206/299
6,508,357 B1 * 1/2003 Faircloth et al. ..... 206/284
6,581,765 B1 * 6/2003 Rhyne ..... 206/284

FOREIGN PATENT DOCUMENTS

| | | |
|---|---|---|
| JP | 53-45177 | 9/1951 |
| JP | 44-17040 | 7/1969 |
| JP | 3038131 | 3/1997 |
| JP | 09143811 A * | 6/1997 |

* cited by examiner

*Primary Examiner*—Mickey Yu
*Assistant Examiner*—J. Gregory Pickett
(74) *Attorney, Agent, or Firm*—Kirschstein, et al.

(57) ABSTRACT

A packaging material capable of displaying commodities such as clothes attractively as viewed from both front and rear sides thereof has a single sheet having sheet bodies connected at the front rear sides through a band part. Extension pieces are provided at the right and left sides of the front sheet body through bent parts. Locks are provided at the right and left ends of the extension pieces to lock the extension pieces to each other in the overlapped state. Additional extension pieces are connected at the right and left sides of the rear sheet body through bent parts having a width smaller than that of the band part. Additional locks are provided at the right and left ends of the additional extension pieces to lock the additional extension pieces to each other in the overlapped state, and a slit allows the extension pieces to be locked to each other between the rear sheet body and the bent parts.

4 Claims, 2 Drawing Sheets

PACKAGING MATERIAL FOR COMMODITY

FIELD OF THE INVENTION

The present invention relates to a packaging material for displaying commodities such as clothes aesthetically.

DESCRIPTION OF THE PRIOR ART

Conventionally, it has been widely practiced to display commodities such as socks and trunks by hanging them on hangers for sale. However, in the case where the front side is different from the rear side and a wrong side is mixed in the displayed commodities, there is feeling of physical disorder and a poor presentation lowers the commodity value.

Here, the object of the present invention is to provide a packaging material capable of displaying commodities such as clothes aesthetically as viewed from both the front and rear sides.

SUMMARY OF THE INVENTION

The above-mentioned object has been solved according to the present invention in which the packaging material is made to consist of a piece of sheet and made to be able to cover wholly the head portion of a commodity (such as folded clothes and the like).

This sheet has rectangular sheet bodies of a substantially same shape at the front and rear sides between which a band part corresponding to the thickness of the commodity to be packaged is sandwiched. Extension pieces are provided at the right and left sides of the front sheet body through bent parts of substantially the same width as the band part. Locking means are provided at the right and left end parts of the extension pieces to lock the extension pieces to each other in the overlapped state.

Extension pieces are also provided at the right and left sides of the rear sheet body through bent parts having a width smaller than that of the above-mentioned band part. Locking means are provided at the right and left end parts of the extension pieces to lock the extension pieces to each other in the overlapped state. Furthermore, slits capable of locking the extension pieces extending from the bent parts of the front sheet body are provided between the rear sheet body and the bent parts provided at the right and left sides of it. It is preferred to provide a small circular notch at the upper end of the slit to lock stably the front extension piece.

The lower end of the extension piece provided at the right and left sides of the front sheet body is on the same line substantially as the line of the sheet body. Its height is preferably about 20 to 60% of that of the sheet body. The lower end of the extension piece provided at the right and left sides of the rear sheet body is on the same line substantially as the line of the sheet body. Its height is preferably about 95 to 60% of that of the sheet body.

Furthermore, in the sheet, an opening can be provided on said band part for equipping the hook material of the hanger to hang the commodity for displaying it.

The bent parts at the right and left sides of the rear sheet body are preferably made so that the upper end is chipped so as to incline from the sheet body to the extension piece to be settled even when the bent parts at the right and left sides of the front sheet body overlap on the upper part and the lower side is notched. Furthermore, it is preferred that the slits provided between the rear sheet body and the bent parts have the substantially same height (depth) as that of the front extension pieces.

DETAILED DESCRIPTION OF THE PREFERRED EMBODIMENT

Figure 1:
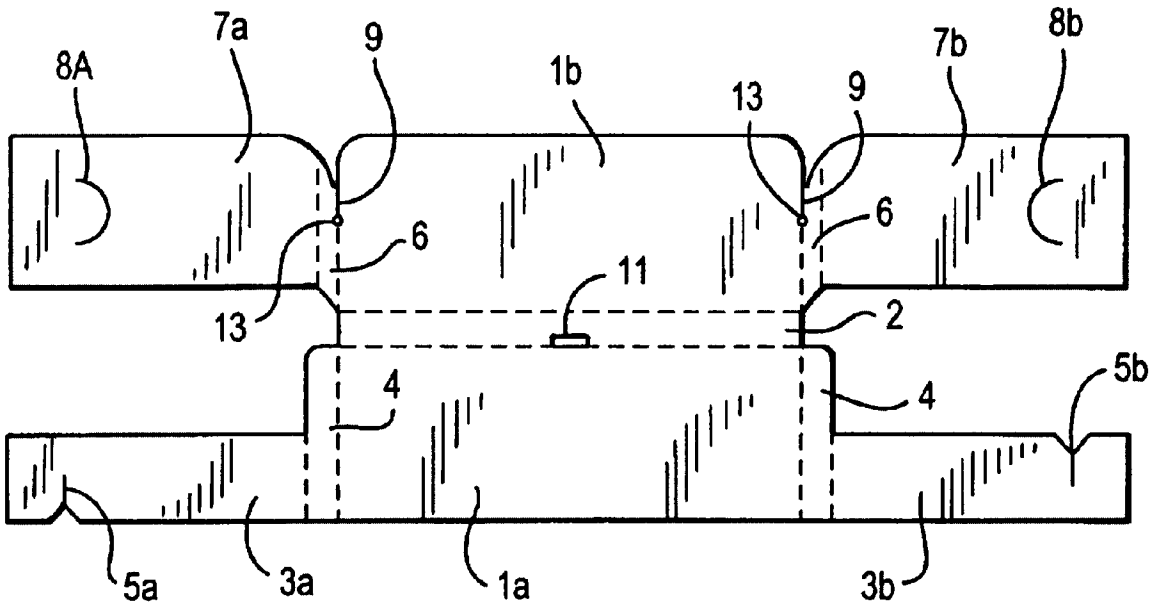
FIG. 1 is a plan view of a sheet showing an example of the present invention.

An example of a sheet of the present invention is shown in FIG. 1. This sheet has sheet bodies 1*a* and 1*b* of 126 mm length and 46 mm height at the front and rear sides and a band part 2 of 126 mm length and 8 mm width is sandwiched between the sheet bodies. Bent parts 4 of 8 mm width are protruded from the right and left sides of the front sheet body 1*a* in the same height as the sheet body 1*a*. Extension pieces 3*a* and 3*b* (78 mm length and 23 mm height) extend from the bent parts 4. The lower ends of the extension pieces 3*a* and 3*b* are on the substantially same line as the lower end of the sheet body 1*a*. Locking means 5*a* and 5*b* (consisting of slits and notches) are provided at the right and left ends of the extension pieces 3*a* and 3*b* to lock them by overlapping.

Bent parts 6 of 5 mm width narrower than the band part 2 are provided at the right and left sides of the rear sheet body 1*b*. Extension pieces 7*a* and 7*b* of 81 mm length and 40 mm height extend from the bent parts 6. The lower ends of the extension pieces 7*a* and 7*b* are positioned on the extension line of the lower end of the sheet body 1*b*. Arc slits are provided at the right and left ends of the extension pieces 7*a* and 7*b* as the locking means 8*a* and 8*b* to lock them by overlapping. Slits 9 are provided between the rear sheet body 1*b* and the bent parts 6 at the right and left sides of it to lock the bent part 4 side of the extension pieces 3*a* and 3*b* of the front sheet body 1*a*. The depth (height) of the slit 9 is made to be 23 mm which is the same as the height of the extension pieces 3*a* and 3*b* locked to it. Its upper end is made to be a circular notch 13 of 2 mm diameter.

In this example, an opening 11 is provided on the band part 2 which becomes to be the top in use to equip the hook material 10 of the hanger.

Figure 2A:
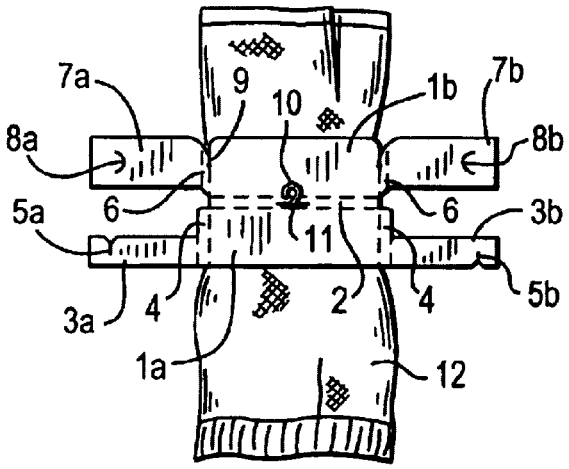
FIGS. 2A–E are illustrative figures showing the use condition of the example of FIG. 1.
Figure 2B:
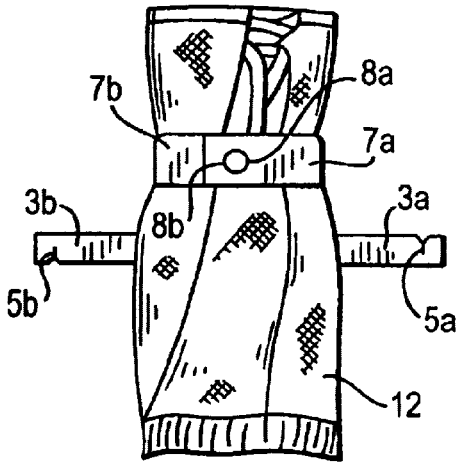
Figure 2C:
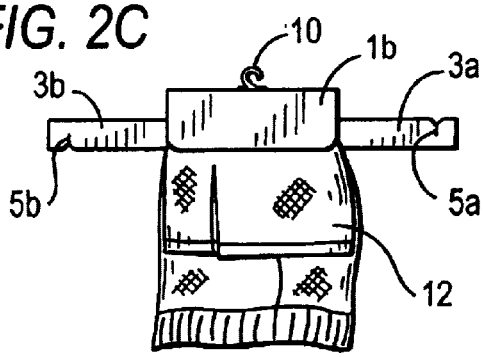
Figure 2D:
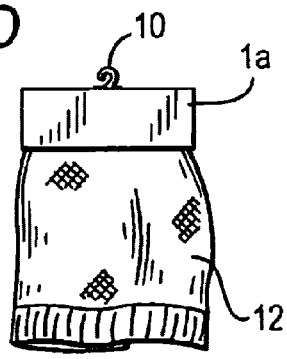
Figure 2E:
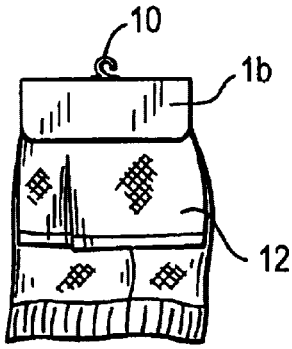

A use condition is shown. First, the sheet is placed on the surface of a commodity (folded trunks in this example) in an extended state (See FIG. 2A). Then, the bent parts 6 of the rear sheet body 1*b* are bent and the extension pieces 7*a* and 7*b* are overlapped on the rear side of the commodity 12 to cover the commodity 12 and the locking means 8*a* and 8*b* are locked to hold the commodity 12 (See FIG. 2B). Thereafter, the commodity 12 is bent so that the band part 2 comes to be the top (See FIG. 2C). Bent parts 4 of the front sheet body 1*a* are bent and extension pieces 3*a* and 3*b* are passed through slits 9 positioned at both sides of the front sheet body 1*a* and overlapped at the rear side of the front sheet body 1*a* to hold the commodity 12 and locking means 5*a* and 5*b* are locked (See FIGS. 2D and E).

Though the extension pieces 3*a* and 3*b* are locked at the rear side of the sheet body 1*a* through the slits 9, as circular notches 13 are present at the top end of slits 9, the upper ends of the slits 9 are not destroyed improperly by insertion of the extension pieces 3*a* and 3*b* to make a stable operation possible.

As the result, the commodity 12 comes to be in which the head part is covered by a cap so that the commodity can be displayed stably and aesthetically with no difference between the front and the rear. Thus, as the packaging material of the present invention can be used by simply folding a single sheet (with no use of binding metals), it can be easily handled. Also, as it can be used by covering uniformly the top part of the commodity with no difference between the front and the rear, it can display the commodity aesthetically and effectively.

What is claimed is:

1. A packaging material, comprising:

a) a single sheet for aesthetically displaying a commodity by covering a part of the commodity, said sheet having a pair of substantially same rectangular front and rear sheet bodies at front and rear sides of the commodity;

b) a band part having a width corresponding to a thickness of the commodity to be packaged sandwiched between the sheet bodies;

c) extension pieces connected at right and left ends of the front sheet body through bent parts of substantially the same width as the band part;

d) locking means at opposite ends of the extension pieces for locking them by overlapping;

e) additional extension pieces connected at right and left ends of the rear sheet body through additional bent parts narrower in width than the band part;

f) additional locking means at opposite ends of the additional extension pieces for locking them by overlapping; and g) slits located between the rear sheet body and the additional bent parts, and operative for receiving and locking the extension pieces of the front sheet body.

2. The packaging material according to claim 1, in which an opening is provided on the band part for equipping a hook material of a hanger.

3. The packaging material according to claim 1, in which lower edges of the extension pieces provided at the right and left ends of the front sheet body are on substantially the same line as a lower edge of the front sheet body and the height of each extension piece is 20 to 60% of that of the front sheet body, and in which lower edges of the additional extension pieces provided at the right and left ends of the rear sheet body are on substantially the same line as a lower edge of the rear sheet body and the height of each additional extension piece is 95 to 60% of that of the rear sheet body.

4. The packaging material according to claim 1, in which each slit has a height substantially the same as that of the extension pieces provided at the right and left ends of the front sheet body.

* * * * *